US006367210B1

(12) United States Patent
Trundle

(10) Patent No.: US 6,367,210 B1
(45) Date of Patent: Apr. 9, 2002

(54) APPARATUS AND METHOD FOR SECURING A PANE AGAINST IMPACT

(75) Inventor: Simon Trundle, Grendon (GB)

(73) Assignee: Framegard Anchoring Systems Limited (GB)

( * ) Notice: Subject to any disclaimer, the term of this patent is extended or adjusted under 35 U.S.C. 154(b) by 0 days.

(21) Appl. No.: 09/463,894

(22) PCT Filed: Jul. 30, 1998

(86) PCT No.: PCT/GB98/02285

§ 371 Date: Apr. 14, 2000

§ 102(e) Date: Apr. 14, 2000

(87) PCT Pub. No.: WO99/06664

PCT Pub. Date: Feb. 11, 1999

(30) Foreign Application Priority Data

Jul. 30, 1997 (GB) ..... 9716105
Jan. 16, 1998 (GB) ..... 9800992

(51) Int. Cl.[7] ..... E06B 3/00

(52) U.S. Cl. ..... 52/204.5; 52/204.53; 52/204.62; 52/718.04; 52/716.1

(58) Field of Search ..... 52/204.5, 204.53, 52/204.62, 718.04, 716.1

(56) References Cited

U.S. PATENT DOCUMENTS

| | | | | |
|---|---|---|---|---|
| 4,075,802 A | | 2/1978 | Gross et al. | |
| 5,553,422 A | | 9/1996 | Gazaway | |
| 5,950,379 A | * | 9/1999 | Moore et al. | 52/204.5 |
| 6,086,138 A | * | 7/2000 | Xu et al. | 52/204.5 |

* cited by examiner

*Primary Examiner*—Beth A. Stephan
*Assistant Examiner*—Chi Nguyen
(74) *Attorney, Agent, or Firm*—Coudert Brothers LLP

(57) ABSTRACT

A window or door has a glass pane (2). In order to secure the pane (2), e.g. against fall-out under impact load or against forced entry, an adhesive film (3) covers the pane (2) and overlaps the surrounding inside surface (4) of a frame (1). Clamping profile (5) is attached along the inside surface (4) of the frame (1) adjacent the pane (2) to clamp the overlapping edge ($3^1$) of the film (3) against the frame (1). The clamping profile (5) has a gasket (11) abutting against the film (3) on the pane (2). In order to secure against increased impact loads and hinder tearing of the film (3), the profile (5) has a curved portion (8) and the gasket (11) protrudes from the profile (5) so as to form a space (15) around the curved portion (8) and allow stretching movement of the film (3) around the curved portion (8) during an impact.

13 Claims, 1 Drawing Sheet

APPARATUS AND METHOD FOR SECURING A PANE AGAINST IMPACT

FIELD OF THE INVENTION

The present invention relates to apparatus and a method for securing a pane of a window or door against impact.

BACKGROUND OF THE INVENTION

It is known to apply window safety film, commonly called applied window film, to the inside face of window panes to prevent glass shattering. Such applied window film consists of a layer or layers of thin polyester adhesive film, which is applied to the inside surface of the glass to improve impact resistance, and also to hold loose shards of glass together when the glass is broken by an impact.

Such applied window films will reduce bomb blast injuries, since the film holds the loose shards together and the whole window pane will drop to the ground as one piece rather than hundreds of cutting shards. Similarly, such films are extensively used in schools and hospitals to resist falling body impact, e.g. where persons trip and fall against non safety-rated glass. The glass shatters, but it does not disintegrate into multiple shards, because the applied window film holds the shards together.

Thicker and stronger films are used to improve smash and grab resistance of retail shop windows. However, it is possible to gain entry by using a lever bar to prise the glass and film away from the edge of the frame, thus creating a hole to allow entry therethrough, e.g. smash and grab or forced entry.

When applied window film is fitted to the inside face of the glass of a window or door, a gap is usually left around the edge of the pane where the film is trimmed against the frame. This means that the glass and applied window film can drop out of the window or door frame if enough force is applied. After bomb blasts it is common to see complete glass sheets with applied film lying inside a building.

It is known to apply the film to the pane so that it overlaps the surrounding frame and to use a beading or profile to clamp the overlapping film to the surrounding frame. Although this does increase the security of the pane against impact considerably, there is a tendency for the film to stretch and tear along the edge of the profile during an impact. Furthermore, where the profile has a gasket engaging the film on the pane, there is also a tendency for the gasket to be pulled out by the film as it stretches during an impact.

An object of the present invention is to provide apparatus and a method for securing a pane of a window or door against impact and avoiding the above-described disadvantages.

SUMMARY OF THE INVENTION

The present invention provides apparatus for securing a pane of a window or door against impact comprising an adhesive film for covering the pane and overlapping a frame surrounding the pane and a clamping profile comprising a first elongate side portion attachable by fixing means therethrough to the surrounding frame to clamp the overlapping film, and a second elongate side portion having a gasket protruding therefrom for cushioning impact movement of the pane and film, wherein the first and second elongate side portions are substantially at right angles to each other and are connected by an elongate curved portion of the profile so as to provide substantially continuous support for the film from the first elongate side portion to the gasket during an impact on the pane and thereby minimise the risk of a tear of the film during impact, the outer surface of the curved portion of the profile having a radius of curvature from 4 mm to 15 mm.

The invention further provides a window or door having a pane and apparatus securing the pane against impact comprising an adhesive film covering the pane and overlapping the surrounding frame and a clamping profile compising a first elongate side portion attached by fixing means therethrough to the surrounding frame to clamp the overlapping film, and a second elongate side portion having a gasket protruding therefrom for cushioning impact movement of the pane and film, wherein the first and second elongate side portions are subtantially at right angles to each other and are connected by an elongate curved portion of the profile to minimise the risk of tearing of the film during an impact on the pane, the outer surface of the curved portion of the profile having a radius of curvature from 4 mm to 15 mm.

The invention still further provides a method of securing a pane of a window or door against impact using an apparatus for securing a pane of a window or door against impact comprising an adhesive film for covering the pane and overlapping the surrounding frame and a clamping profile comprising a first elongate side portion attachable by fixing means therethrough to the surrounding frame to clamp the overlapping film, and a second elongate side portion having a gasket protruding therefrom for cushioning impact movement of the pane and film, wherein the first and second elongate side portions are substantially at right angles to each other and are connected by an elonge curved portion of the profile so as to provide subtantially continuous support for the film from the first elongate side portion to the gasket during an impact on the plane and thereby minimise the risk of tearing of the film during impact, the outer surface of the curved portion of the profile having a radius of curvature from 4 mm to 15 mm. The method of securing comprises covering the pane and overlapping the surrounding frame with the adhesive film, positioning the clamping profile on the surrounding frame so that the gasket abuts against the film on the pane and the first elongate side portion to the surrounding frame by fixing means therethrough so as to clamp the overlapping film against the surrounding frame.

BRIEF DESCRIPTION OF THE DRAWINGS

Embodiments of the invention will now be described, by way of example only, with reference to the accompanying drawings, wherein.

DETAILED DESCRIPTION OF THE INVENTION

Figure 1:
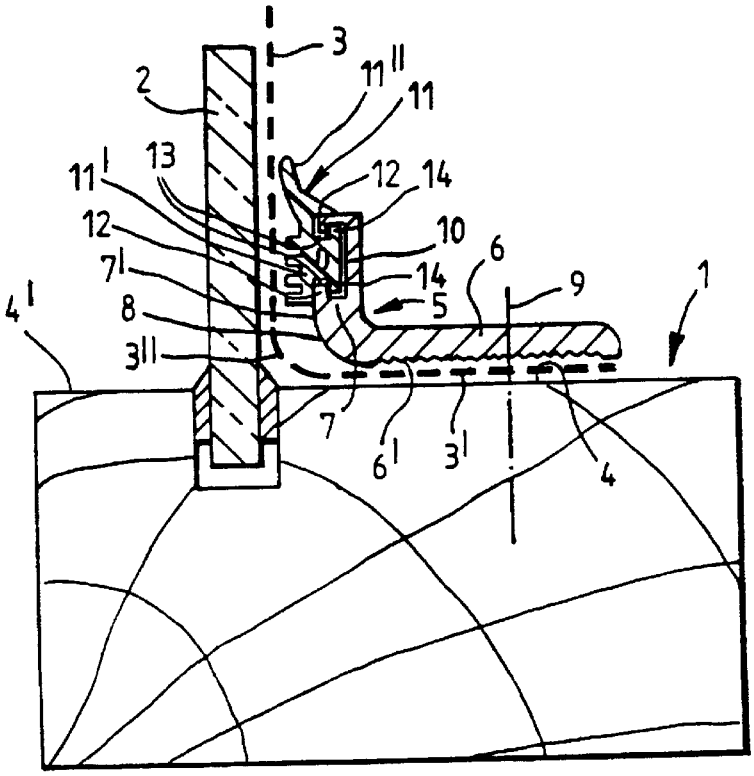
FIG. 1 is a cross-section through part of a window provided with a first embodiment of apparatus according to the invention.

In FIG. 1 a window frame 1 has a glass pane 2. A sheet of applied window film 3 is installed on the inside of the pane 2 and beyond the edge thereof so as to overlap at its edge $\mathbf{3}^1$ the inside surface 4 of the frame 1. Clamping profile or beadings comprises a first elongate side portion 6 facing the inside surface 4 of the frame 1, a second elongate side portion 7 facing the pane 2 and an elongate curved portion 8 connecting the first and second elongate side portions 6, 7.

As can be seen from FIG. 1 the first and second elongate side portions are arranged substantially at right angles to one another.

The radius of curvature of the outside surface of the curved portion 8 may be from 4 mm to 15 mm. The curved portion 8 preferably extends over substantially 90° so that there is no unevenness between the first and second elongate portions 6 and 7.

The first elongate side portion 6 has apertures for screws or other fixing means, represented diagrammatically by line 9, extending therethrough into the frame 1, so as to clamp the overlapping edge $3^1$ of the film 3 against the inside surface 4 of the frame. The outside surface $6^1$ of the first elongate portion 6 is uneven and may be in the form of ribs, pips or other raised portions to provide frictional grip between the first elongate member 1 and the film edge $3^1$, thereby preventing the overlapping edge $3^1$ of the film being pulled away and becoming unclamped during an impact on the pane 2.

The side $7^1$ of the second elongate side portion 7 facing the pane 2 has a rebate 10 therein accommodating a compression gasket 11. The gasket 11 has a main cushioning portion $11^1$ and a subsidiary cushioning portion in the form of an integral elongate flange or lip $11^{11}$ extending from the main cushioning portion $11^1$ in a direction along the pane 2 away from the curved portion 8. The main cushioning portion $11^1$ is grooved to enhance cushioning of the pane 2 and film 3 during an impact. The gasket 11 also allows stretching movement of the film 3 across the gasket without tearing of the film 3.

The rebate 10 has two facing overhang projections 12 engaging in grooves 13 on opposite sides of the main cushioning portion 11. The resultingly formed, oppositely directed projections 14 inside the rebate 10 engaging the underside of the overhang projections 12 and hold the gasket 11 firmly on the profile 5.

It can be seen that the gasket 11 projects outwardly from the side $7^1$ of the second elongate side portion 7 and abuts against the film 3 on the pane 2. This means that the second elongate side portion 7 is spaced from the pane 2 so that there is an unrestricted space 15 around the curved portion 8 between the pane 2 and the inside surface 4 of the frame 1. This space 15, in conjunction with the curved portion 8 of the profile 5 is crucial to the operation of the invention.

Under impact load, e.g. a bomb blast or forced entry outside the frame 1, the pane 2 and the film 3 bend inwardly. The clamped portion $3^1$ of the film cannot move, but the adjacent unclamped portion $3^{11}$ of the film 3 can move freely, thus allowing the film 3 to stretch and hence absorb impact energy around the curved edge portion 8, i.e. over a substantially large area in comparison with the usual right-angle edge of known clamping profile since the film 3 is stretched around the curved portion 8, as opposed to a right-angle edge, the risk of tearing of the film is reduced. Thus the pane 2 can be secured against considerably greater impacts than with known profiles.

The clamping profile 5 may be extruded from any suitable material, e.g. aluminium or plastics (e.g. PVC). Alternatively, the profile 5 may be formed of wood, in which case it could be solid; it should, of course, be provided with the uneven surface $6^1$, the curved portion 8 and the rebate 10 firmly retaining the gasket 11.

In FIG. 1, the film 3 and the profile 5 have been applied to the inside surface 4 on the inside of the window pane, but they could be applied to the outside of the window pane, i.e. to the inside surface $4^1$ on the outside of the window pane as long as there is sufficient distance between the pane 2 and the outer edge of inside surface $4^1$.

Figure 2:
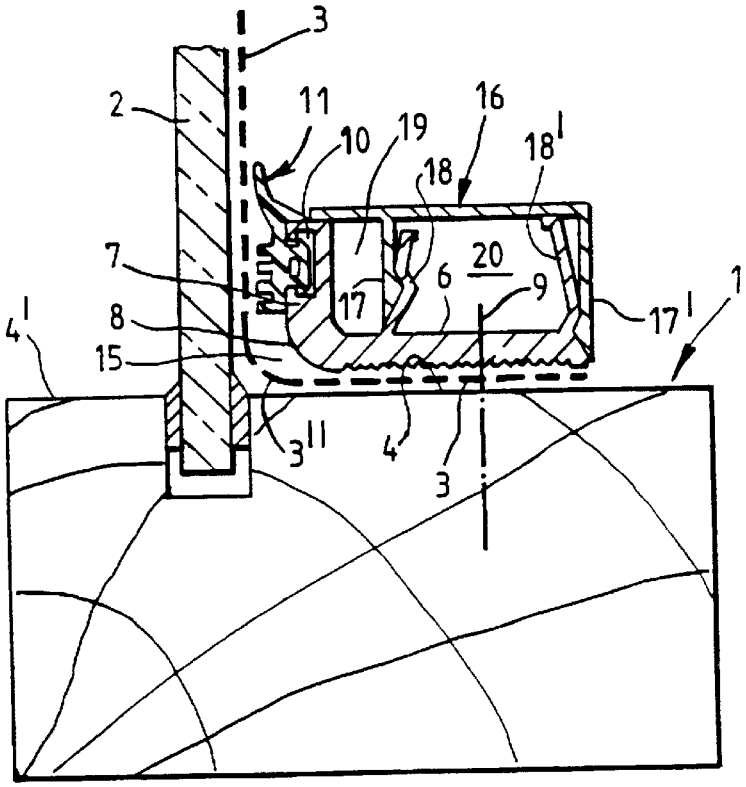
FIG. 2 is a cross-section through part of a window provided with a second embodiment of apparatus according to the invention.

In the embodiment of FIG. 2 the profile 5 is provided with a capping member 16. The capping member 16 has two depending legs 17, $17^1$ engaging with corresponding uprights 18, $18^1$ on the inside of the first elongate side portion 6 with a snap-fit.

Two cavities 19, 20 are formed between the clamping profile 5 and the capping member 16. The cavity 19 is between the leg 17 and the second elongate side portion 7, and the cavity 20 is between the two uprights 18, $18^1$. The cavity 19 may be filled with a bonding agent (e.g. silicone or adhesive) to prevent removal of the capping member 16 and thereby prevent access to the cavity 20 covering the screws 9 and unauthorised removal of the clamping profile 5, the film 3 and the pane 2.

Although in the embodiment of FIG. 2 the capping member 16 is attached to the profile by means of a snap-fit, this is not essential. For example, the legs 17, $17^1$ and the uprights 18, $18^1$ could be planar and be bonded to each other by adhesive. Alternatively, the leg 17 and the uprights 18, $18^1$ could be planar or omitted, and the leg $17^1$ could be attached to the edge of the first elongate side portion 6 with adhesive or a snap-fit, and the front, top edge of the capping member 16 could be attached to the edge of the second elongate member 7, also with adhesive or with a snap-fit.

The above described invention prevents pane fall-out under impact load, e.g. a bomb blast, and also makes smash and grab or forced entry more difficult. Because of the curved portion 8 it is difficult for a levering tool to gain purchase on the clamping profile 5. The screws 9 also provide resistance against any direct force applied, e.g. by a hammer-driven wedge.

Although the above embodiments are described in relation to a window, the invention may of course be applied to a door or any other panel having a glass or even a plastics pane.

What is claimed is:

1. Apparatus for securing a pane of a window or door against impact comprising an adhesive film for covering the pane and overlapping a frame surrounding said pane and a clamping profile comprising a first elongate side portion attachable by fixing means therethrough to the surrounding frame to clamp the overlapping film, and a second elongate side portion having a gasket protruding therefrom for cushioning impact movement of the pane and film, wherein the first and second elongate side portions are substantially at right angles to each other and are connected by an elongate curved portion of the profile so as to provide substantially continuous support for the film from the first elongate side portion to the gasket during an impact on the pane and thereby minimise the risk of a tear of the film during impact, the outer surface of the curved portion of the profile having a radius of curvature from 4 mm to 15 mm.

2. Apparatus as claimed in claim 1, wherein the outer surface of the curved portion of the profile has a radius of curvature from 4 mm to 8 mm.

3. Apparatus as claimed claim 1, wherein the gasket is engagedly held in a rebate in the second elongate side portion to hinder withdrawal of the gasket from the rebate during an impact on the pane.

4. Apparatus as claimed in claim 3, wherein the gasket has oppositely directed projections engaging in the rebate to hinder withdrawl of the gasket during an impact on the pane.

5. Apparatus as claimed claim 1, wherein the gasket has a main cushioning portion and a subsidiary cushioning portion integral therewith and in the form of an elongate flange or lip extending from the main cushioning portion in a direction away from the curved portion of the profile.

6. Apparatus as claimed in claim 1, wherein the first elongate side portion has an uneven surface along a side thereof to provide a friction clamping grip of the overlapping film against the surrounding frame.

7. Apparatus as claimed in claim 1, wherein the clamping profile is an extruded section.

8. Apparatus as claimed in claim 7, wherein the clamping profile has an elongate capping member to hinder access to the fixings means.

9. Apparatus as claimed in claim 8, wherein the capping member is attached to the clamping profile by means of a snap-fit.

10. Apparatus as claimed in claim 9, wherein the capping member has two legs engaging with two upright portions of the clamping profile.

11. A window or door having a pane and apparatus securing the pane against impact comprising an adhesive film covering the pane and overlapping the surrounding frame and a clamping profile comprising a first elongate side portion attached by fixing means therethrough to the surrounding frame to clamp the overlapping film, and a second elongate side portion having a gasket protruding therefrom for cushioning impact movement of the pane and film, wherein the first and second elongate side portions are substantially at right angles to each other and are connected by an elongate curved portion of the profile to minimise the risk of tearing of the film during an impact on the pane, the outer surface of the curved portion of the profile having a radius of curvature from 4 mm to 15 mm.

12. A window or door as claimed in claim 11, wherein the apparatus securing the pane against impact includes an adhesive film for covering the pane and overlapping a frame surrounding said pane and a clamping profile comprising a first elongate side portion attachable by fixing means therethrough to the surrounding frame to clamp the overlapping film, and a second elongate side portion having a gasket protruding therefrom for cushioning impact movement of the pane and film, wherein the first and second elongate side portions are substantially at right angles to each other and are connected by an elongate curved portion of the profile so as to provide substantially continuous support for the film from the first elongate side portion to the gasket during an impact on the pane and thereby minimize the risk of a tear of the film during impact, the outer surface of the curved portion of the profile having a radius of curvature from 4 mm to 15 mm as claimed in claim 1.

13. A method of securing a pane of a window or door against impact using apparatus as claimed in claim 1 comprising covering the pane and overlapping the surrounding frame with the adhesive film, positioning the clamping profile on the surrounding frame so that the gasket abuts against the film on the pane and the first elongate portion abuts against the overlapping film on the surrounding frame, and attaching the first elongate side portion to the surrounding frame by fixing means therethrough so as to clamp the overlapping film against the surrounding frame.

* * * * *